US010464785B2

(12) United States Patent
Ludwig et al.

(10) Patent No.: US 10,464,785 B2
(45) Date of Patent: Nov. 5, 2019

(54) STEP CHAIN FOR ESCALATORS, AND PERSON CONVEYOR DEVICE HAVING A STEP CHAIN OF THIS TYPE

(71) Applicants: THYSSENKRUPP ELEVATOR AG, Essen (DE); thyssenkrupp AG, Essen (DE)

(72) Inventors: Reiner Ludwig, Börnsen (DE); Maxim Golzew, Geesthacht (DE)

(73) Assignees: THYSSENKRUPP ELEVATOR AG, Essen (DE); THYSSENKRUPP AG, Essen (DE)

( * ) Notice: Subject to any disclaimer, the term of this patent is extended or adjusted under 35 U.S.C. 154(b) by 0 days.

(21) Appl. No.: 15/737,520

(22) PCT Filed: Jun. 29, 2016

(86) PCT No.: PCT/EP2016/065148

§ 371 (c)(1),
(2) Date: Dec. 18, 2017

(87) PCT Pub. No.: WO2017/001480

PCT Pub. Date: Jan. 5, 2017

(65) Prior Publication Data

US 2018/0170717 A1 Jun. 21, 2018

(30) Foreign Application Priority Data

Jun. 29, 2015 (DE) ..... 10 2015 212 031

(51) Int. Cl.
*B66B 23/02* (2006.01)
*B66B 21/02* (2006.01)

(52) U.S. Cl.
CPC ..... *B66B 23/024* (2013.01); *B66B 21/02* (2013.01)

(58) Field of Classification Search
CPC ..... F16G 13/02
(Continued)

(56) References Cited

U.S. PATENT DOCUMENTS 5,553,697 A * 9/1996 McClement ..... B66B 23/145 198/332
6,074,318 A 6/2000 Tanaka et al.
(Continued)

FOREIGN PATENT DOCUMENTS

CN 102066229 A 5/2011
DE 1039319 B 9/1958
(Continued)

OTHER PUBLICATIONS

English language machine translation for DE 1039319 B listed above.
(Continued)

*Primary Examiner* — Saul Rodriguez
*Assistant Examiner* — Lester III Rushin
(74) *Attorney, Agent, or Firm* — thyssenkrupp North America, Inc.

(57) ABSTRACT

A step chain for driving steps of an escalator may include link plates, chain pins, chain bushes, and buffer rollers that are connected to one another to form chain links, which can be moved in relation to one another. The step chain may also include running rollers disposed outside the chain links. The buffer rollers may each be designed in the form of a multi-component part that comprises at least one inner, dimensionally stable sliding component, by way of which the buffer rollers can be arranged in a rotatable manner, respectively, on the chain bushes, and an outer, damping component that is designed to be more elastically deformable than the sliding component. The step chain may be utilized in a person-conveyor device, such as an escalator or a moving walkway, for example.

18 Claims, 1 Drawing Sheet

(58) Field of Classification Search
USPC ..... 198/844.1, 845
See application file for complete search history.

(56) References Cited

U.S. PATENT DOCUMENTS

| | | | | |
|---|---|---|---|---|
| 8,740,761 | B2 * | 6/2014 | Tullmann | B23Q 3/15526 211/1.56 |
| 2002/0179404 | A1 | 12/2002 | Ishikawa | |
| 2008/0229965 | A1 * | 9/2008 | Balash | B60S 3/004 104/162 |
| 2009/0139830 | A1 | 6/2009 | Gonzalez Alemany | |
| 2010/0084245 | A1 | 4/2010 | Gonzalez Alemany | |

FOREIGN PATENT DOCUMENTS

| | | | |
|---|---|---|---|
| DE | 4334064 | A | 4/1995 |
| DE | 102008002455 | A | 12/2009 |
| DE | 102013107869 | A | 1/2015 |
| EP | 0094110 | A | 11/1983 |
| ES | 2300225 | A | 6/2008 |
| ES | 2340563 | A | 6/2010 |
| ES | 2455391 | A | 4/2014 |
| FR | 1294264 | A | 5/1962 |
| WO | 2004083679 | A | 9/2004 |

OTHER PUBLICATIONS

English language machine translation for FR 1294264 A listed above.
English Translation of International Search Report issued in PCT/EP2016/065148, dated Nov. 3, 2016 (dated Nov. 15, 2016).

* cited by examiner

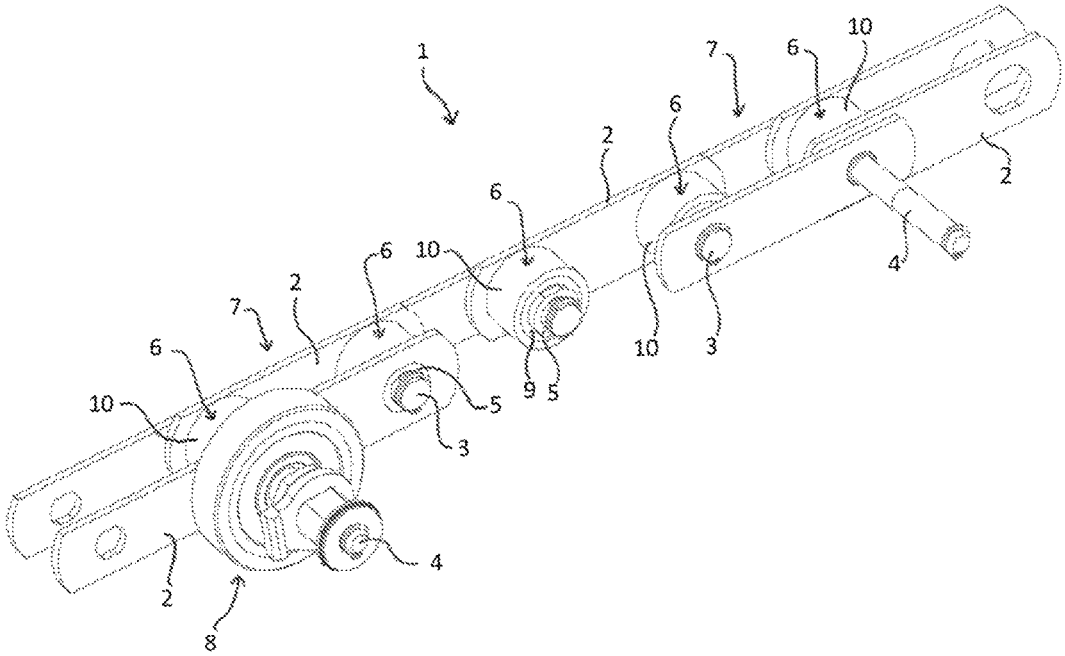
1
7
6
10
6
2
2
6
10
6
2
7
6
10
10
3
4
9
5
5
3
4
2
8

STEP CHAIN FOR ESCALATORS, AND PERSON CONVEYOR DEVICE HAVING A STEP CHAIN OF THIS TYPE

CROSS REFERENCE TO RELATED APPLICATIONS

This application is a U.S. National Stage Entry of International Patent Application Serial Number PCT/EP2016/065148, filed Jun. 29, 2016, which claims priority to German Patent Application No. DE 10 2015 212 031.7, filed Jun. 29, 2015, the entire contents of both of which are incorporated herein by reference.

FIELD

The present disclosure generally relates to escalators and person-conveyor devices, including step chains for such escalators and person-conveyors that operate at reduced noise levels.

BACKGROUND

Drive chains such as step chains have been known for some time in the prior art. It is known here, in particular, for a chain joint of such a drive chain to comprise two inner link plates, which are connected in a rotationally fixed manner by a chain bush to form a pair of inner link plates. It is also known here for the chain bush to have a chain pin engaging through it, the chain pin connecting two outer link plates to one another to form a pair of outer link plates. A buffer roller is arranged in a movable manner here on the chain bush.

If such a drive chain is driven by means of a chain wheel, then teeth of the chain wheel engage in the interspaces present between the buffer rollers of the drive chain, wherein the buffer rollers are each temporarily in engagement with the tooth flanks of the chain wheel. It is known to be a problem here that this engagement results in an undesirable development of noise.

For noise-damping purposes, WO 2004/083679 A1 discloses the practice of arranging a damping means between the chain bush or bushing and the roller of the chain links. The damping means is intended here to absorb as far as possible the kinetic energy which is released when the chain runs into a chain wheel, and the chain rollers strike against the tooth flanks of the chain wheel, and thus to reduce the noise level.

Furthermore, DE 10 2008 002 455 A1 discloses a drive chain in which, in order to reduce the noise level, a sliding bush is arranged between the chain bush and the buffer roller, said sliding bush providing for an eccentric offset between the chain bush and the buffer roller.

Thus a need exists for an escalator step chain where the step chain has a reduced noise level and can advantageously be produced more cost-effectively, as well as an escalator with a noise level that is reduced in a cost-effective manner.

BRIEF DESCRIPTION OF THE FIGURE

The FIGURE is a perspective schematic view of an example step chain.

DETAILED DESCRIPTION

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element, even where other elements in the same claim or different claims are preceded by 'at least one' or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The present disclosure generally relates to step chains for driving steps of escalators. In some examples, a step chain may include link plates, chain pins, chain bushes, and buffer rollers, which are connected to one another to form chain links that can be moved in relation to one another. In some examples, the step chain may also include running rollers arranged outside the chain links, as a result of which the step chain is suitable in particular for driving steps of an escalator that is designed for an average to high volume of traffic. Still further, the present disclosure relates to person-conveyor devices, in particular escalators or moving walkways that have a step belt or pallet belt, respectively, and a drive unit. In some examples, the step belt or the pallet belt is connected to a drive unit for driving the step belt or pallet belt via at least one step chain.

A step chain for driving steps of an escalator may include link plates, chain pins, chain bushes and buffer rollers. The link plates, chain pins, chain bushes and buffer rollers are connected to one another here to form chain links which can be moved in relation to one another, in particular to form chain links which can be pivoted in relation to one another. The step chain also comprises running rollers arranged outside the chain links, in particular on extended chain pins alongside the chain links or on hollow spindles which are fastened on the step. When use is made of the step chain, that is to say when the step chain is driven by means of a chain wheel, the running rollers roll advantageously over a running rail, the chain links of the step chain therefore being supported. This advantageously reduces the wear to the step chain. A further advantage of the step chain is that the advantageous configuration of the buffer rollers reduces the local maximum surface pressure between a tooth of the drive wheel or chain wheel and the roller.

The buffer rollers of the step chain according to the invention are each designed in the form of a multi-component part which comprises at least one inner, dimensionally stable sliding component and an outer, damping component. By way of the inner, sliding component, the buffer rollers are arranged in a rotatable manner in each case on the chain bushes. When use is made of the step chain, that is to say when the step chain is driven by a chain wheel, the outer, damping component of the respective buffer roller is in temporary engagement with tooth flanks of a chain wheel. The outer, damping component is designed to be more elastically deformable here than the inner, sliding component. The inner, sliding component of a buffer roller of the step chain is thus designed to be, in particular, more dimensionally stable, and thus advantageously harder, than the outer, damping component. The buffer roller is advantageously designed here in the form of a single-part component.

As a result of the inner, sliding component, which can form in particular the carrying body for a respective buffer roller of the step chain, the buffer rollers are advantageously particularly capable of sliding, which advantageously reduces the friction and thus the wear between the buffer rollers and the chain bushes. Therefore, the step chain is advantageously more durable and runs more smoothly.

In contrast, the outer, damping component advantageously reduces the noise when the step chain engages in a chain wheel when use is made of the step chain. The installation of additional damping buffers on the chain wheels can be dispensed with here on account of the damping components of the buffer rollers of the step chain according to the invention. As a result of the damping component of a respective buffer roller, the buffer rollers are advantageously designed pretty much themselves in the form of a damping element.

In particular, provision is made, in the case of the step chain, for the inner, sliding component and the outer, damping component of a buffer roller of the step chain to be arranged coaxially in relation to the chain bush. The inner, sliding component and the outer, damping component of a buffer roller of the step chain here are advantageously in the form of a hollow cylinder.

In particular, provision is made for the buffer rollers of a step chain according to the invention to have a larger diameter than known buffer rollers, which in particular do not comprise a damping component. It is advantageously the case that the sliding component of each buffer roller of the step chain comprises the same diameter as a conventional buffer roller mentioned above. The damping component here advantageously comprises at least the same thickness as the sliding component. In other words, the distance between the inner radius and outer radius of the damping component corresponds to the distance between the inner radius and the outer radius of the sliding component, or is even larger. The distance between the inner radius and outer radius of the damping component here is advantageously no larger than twice the distance between the inner radius and the outer radius of the sliding component.

As a variant of the invention, provision is made for at least one intermediate component, in particular a further damping component or a carrier component of the buffer roller, to be arranged between the inner, sliding component and the outer, damping component.

According to a further variant of the invention, in contrast, provision is made for the buffer rollers of the step chain each to be designed in the form of a two-component part. In other words, in the case of this configuration, the buffer rollers each comprise an inner, sliding component and an outer, damping component, wherein advantageously the outer, damping component is arranged directly on the inner, sliding component so as to enclose the inner, sliding component. This variant can be produced here advantageously in a particularly cost-effective manner. It is advantageously the case that the buffer rollers of the step chain, in addition, are designed in one part, that is to say in the form of a single-part component. This advantageously further reduces production costs.

According to a particularly advantageous development of the invention, the buffer rollers of the step chain are each injection moldings, in particular plastics injection moldings. In other words, a buffer roller of the step chain is designed, in particular, in the form of a multi-component injection molding, particularly preferably in the form of a two-component injection molding. It is advantageously the case, therefore, that injection molding is used to produce the buffer rollers of the step chain in each case with an inner, sliding component and an outer, damping component, wherein advantageously a first material is used for the sliding component and a second material is used for the damping component, such that the hardened first material is stronger, that is to say in particular harder or more dimensionally stable, than the hardened second material. The hardened second material, in contrast, is advantageously designed to be elastically deformable, in particular more elastically deformable than the first hardened material. As a result, the damping component, in contrast to the sliding component, is advantageously compliant and thus advantageously damps impacts between the buffer rollers and tooth flanks of a chain wheel when the buffer rollers of a driven step chain run into a chain wheel. The noises associated with the action of buffer rollers running into a chain wheel are advantageously reduced as a result.

According to an advantageous variant, the first material is metal, in particular steel, and the second material is a plastics material.

In particular, provision is made for the inner, sliding component and the outer, damping component of a respective buffer roller of the step chain to be arranged coaxially in relation to one another. This symmetrical arrangement advantageously results in the respective buffer roller running very smoothly. In addition, such a configuration, in particular in conjunction with the buffer rollers being configured in the form of injection moldings, can be realized in a particularly cost-effective manner.

A further advantageous configuration of the invention provides for the sliding component of a respective buffer roller of the step chain to be made of a first plastics material and a damping component of a respective buffer roller of the step chain to be made of a second plastics material.

The first plastics material is advantageously harder here than the second plastics material. In particular, the first plastics material advantageously has good sliding properties. In contrast, the second plastics material is advantageously more elastically deformable than the first plastics material. In particular, the second plastics material has good damping properties. Expressed in more general terms, the material of the sliding component of a respective buffer roller of the step chain comprises a considerably greater modulus of elasticity than the material of the damping component of a respective buffer roller of the step chain. According to an advantageous configuration, the material of the sliding component comprises, in particular, a modulus of elasticity like that, or similar to that, of steel, whereas the material of the damping component may comprise, in particular, a modulus of elasticity like that, or similar to that, of rubber.

In particular, provision is made for the first plastics material to be polyamide (PA6) or polyoxymethylene (POM). This material advantageously ensures good sliding properties of the sliding components of a respective buffer roller of the step chain.

A further advantageous configuration of the invention provides for the second plastics material to be polyurethane (PU). This material advantageously ensures good damping properties of the damping component of a respective buffer roller of the step chain.

The person-conveyor device proposed in order to achieve the object mentioned in the introduction comprises tread elements which are connected to form an endless tread-element belt, and also a drive unit. The tread-element belt here is connected to the drive unit for driving the tread-element belt via at least one step chain, wherein the at least one step chain is designed according to the invention, in other words is designed in particular in accordance with a configuration according to the invention like that described above. It is possible here for the at least one step chain of the person-conveyor device to comprise the above described features in particular individually or in combination.

By making use of a step chain designed according to the invention, the person-conveyor device is advantageously designed, at comparatively low costs, with a reduced noise level.

In particular, provision is made for the person-conveyor device to be an escalator or a moving walkway, wherein the tread elements are steps or pallets, which are connected to form an endless step belt or pallet belt, respectively.

The exemplary embodiment illustrated in the FIGURE shows part of a step chain 1. The step chain 1 is designed here for driving steps of an escalator. The step chain 1 comprises link plates 2, chain pins 3, chain bushes 5 and buffer rollers 6, which are connected to one another to form chain links 7 which can be moved in relation to one another. The link plates 2 here form, alternately in each case, inner pairs of link plates and outer pairs of link plates.

The step chain 1 also comprises running rollers 8 arranged outside the chain links 7. In the case of the exemplary embodiment illustrated, said running rollers are arranged in a rotatable manner on hollow spindles 4, which are fastened or to be fastened on the steps of an escalator (not illustrated in the FIGURE), in other words the running rollers are arranged pretty much alongside the chain links. However, it is also possible for the running rollers 8 to be arranged in a rotatable manner, in particular, on extended chain pins. As a result of the running rollers 8, the step chain 1 is suitable in particular for driving steps of an escalator designed for an average to high volume of traffic.

The buffer rollers 6 of the step chain 1 are designed in the form of two-component plastics injection moldings. The buffer rollers 6 here comprise an inner, sliding component 9 and an outer, damping component 10. The sliding component 9 here is made of a hard, dimensionally stable plastics material, for example polyamide or polyoxymethylene. The damping component 10 is made of a less hard, more elastically deformable plastics material, for example of polyurethane.

The sliding component 9 and the damping component 10 are each arranged coaxially in relation to one another and each form hollow cylinders. In this exemplary embodiment, the thickness of the damping component 10 corresponds essentially to the thickness of the sliding component 9.

By way of the sliding component 9, the respective buffer rollers 6 of the step chain 1 are arranged in a movable, in particular rotatable, manner in each case on the chain bushes 5. The first plastics material gives the sliding component 9 good sliding properties here.

When use is made of the step chain 1, in particular for driving a step belt of an escalator, the damping components 10 are in engagement, temporarily in each case, with the driving chain wheel (not illustrated in the FIGURE), that is to say from the time at which a damping component 10 runs into the chain wheel until the time at which the damping component 10 runs out of the chain wheel. As a result of the damping realized by the damping component 10, the level of noise associated with using the step chain 1 is advantageously reduced.

The exemplary embodiments illustrated in the FIGURE and explained in conjunction therewith serve to explain the invention and do not have a limiting effect thereon.

LIST OF REFERENCE SIGNS

1 step chain
2 link plate
3 chain pin
4 hollow spindle
5 chain bush
6 buffer roller
7 chain link
8 running roller
9 sliding component
10 damping component

What is claimed is:

1. A step chain for driving steps of an escalator, the step chain comprising:

link plates, chain pins, chain bushes, and buffer rollers that are connected to form chain links, wherein the chain links are movable relative to one another, wherein each of the buffer rollers is configured as a multi-component part that comprises:

an inner dimensionally-stable sliding component by way of which the buffer rollers are disposed in a rotatable manner, respectively, on the chain bushes, and an outer damping component configured to be more elastically deformable than the inner dimensionally-stable sliding component; and running rollers disposed outside the chain links;

wherein the inner dimensionally-stable sliding component is comprised of a first plastics material and the outer damping component is comprised of a second plastics material.

2. The step chain of claim 1 wherein each of the buffer rollers is configured as a two-component part.

3. The step chain of claim 1 wherein each of the buffer rollers is an injection molding.

4. The step chain of claim 1 wherein the inner dimensionally-stable sliding component and the outer damping component are disposed coaxially relative to one another.

5. The step chain of claim 1 wherein the first plastics material is harder than the second plastics material.

6. The step chain of claim 1 wherein the first plastics material is polyamide or polyoxymethylene.

7. The step chain of claim 5 wherein the first plastics material is polyamide or polyoxymethylene.

8. The step chain of claim 1 wherein the second plastics material is polyurethane.

9. The step chain of claim 7 wherein the second plastics material is polyurethane.

10. A person-conveyor device comprising:

tread elements that are connected to form an endless tread-element belt;

a drive unit; and a step chain that comprises link plates, chain pins, chain bushes, and buffer rollers that are connected to form chain links, wherein the chain links are movable relative to one another, wherein each of the buffer rollers is configured as a multi-component part that includes an inner dimensionally-stable sliding component by way of which the buffer rollers are disposed in a rotatable manner, respectively, on the chain bushes, and an outer damping component configured to be more elastically deformable than the inner dimensionally-stable sliding component, and running rollers disposed outside the chain links, wherein the endless tread-element belt is connected to the drive unit for driving the endless tread-element belt via the step chain;

wherein the inner dimensionally-stable sliding component is comprised of a first plastics material and the outer damping component is comprised of a second plastics material.

11. The person-conveyor device of claim 10 wherein each of the buffer rollers is configured as a two-component part.

12. The person-conveyor device of claim 10 wherein each of the buffer rollers is an injection molding.

13. The person-conveyor device of claim 10 wherein the inner dimensionally-stable sliding component and the outer damping component are disposed coaxially relative to one another.

14. The person-conveyor device of claim 10 wherein the first plastics material is polyamide or polyoxymethylene.

15. The person-conveyor device of claim 10 wherein the second plastics material is polyurethane.

16. The person-conveyor device of claim 10 wherein the first plastics material is harder than the second plastics material.

17. The person-conveyor device of claim 16 wherein the first plastics material is polyamide or polyoxymethylene.

18. The person-conveyor device of claim 16 wherein the second plastics material is polyurethane.

* * * * *